US012637280B2

(12) United States Patent
Patel

(10) Patent No.: US 12,637,280 B2
(45) Date of Patent: May 26, 2026

(54) VALVE FOR AEROSOL CONTAINER

(71) Applicant: Bhogilal Laljibhai Patel, Mumbai (IN)

(72) Inventor: Bhogilal Laljibhai Patel, Mumbai (IN)

(73) Assignee: Bhogilal Laljibhai Patel, Mumbai (IN)

( * ) Notice: Subject to any disclaimer, the term of this patent is extended or adjusted under 35 U.S.C. 154(b) by 143 days.

(21) Appl. No.: 18/563,258

(22) PCT Filed: May 17, 2022

(86) PCT No.: PCT/IN2022/050472
§ 371 (c)(1),
(2) Date: Nov. 21, 2023

(87) PCT Pub. No.: WO2022/249197
PCT Pub. Date: Dec. 1, 2022

(65) Prior Publication Data

US 2024/0286822 A1 Aug. 29, 2024

(30) Foreign Application Priority Data

May 26, 2021 (IN) ..... 202121023421

(51) Int. Cl.
*B65D 83/16* (2006.01)
*B65D 83/36* (2006.01)

(52) U.S. Cl.
CPC ..... *B65D 83/164* (2025.01); *B65D 83/36* (2013.01)

(58) Field of Classification Search
CPC ..... B65D 83/164; B65D 83/36
USPC ..... 222/402.1
See application file for complete search history.

(56) References Cited

U.S. PATENT DOCUMENTS 4,141,472 A * 2/1979 Spitzer ..... B65D 83/44 222/402.18
4,230,243 A * 10/1980 Spitzer ..... B65D 83/48 222/402.18
4,475,667 A * 10/1984 Ori ..... B65D 83/36 222/402.19
4,572,406 A * 2/1986 Pratt ..... B65D 83/32 222/464.2
6,824,079 B2 * 11/2004 Kendrick ..... B65D 83/48 239/354
2008/0067262 A1 * 3/2008 Varanasi ..... B05B 1/24 222/402.1
2009/0020621 A1 * 1/2009 Clark ..... B05B 1/3442 222/402.1

(Continued)

FOREIGN PATENT DOCUMENTS

BE 1003982 A3 7/1992
CA 2724253 C 6/2013

(Continued)

*Primary Examiner* — David P Angwin
(74) *Attorney, Agent, or Firm* — The Webb Law Firm

(57) ABSTRACT

A valve for an aerosol container includes a housing, a stem fastened to a mounting cup by a stem gasket, a stem venturi connecting stem to the housing cavity, a spring, and a push-button (actuator) at the top of the stem. The push-button (actuator) has an orifice and a diptube at the bottom of the housing. At least three housing venturi connect different points of the housing to the inner space of the aerosol container so as to keep the housing cavity flooded with material/product at any angle, position and direction of the aerosol container.

10 Claims, 2 Drawing Sheets

(56) References Cited

U.S. PATENT DOCUMENTS

| | | | | |
|---|---|---|---|---|
| 2013/0008982 | A1* | 1/2013 | Shah | B05B 1/3421 239/494 |
| 2021/0169061 | A1* | 6/2021 | Majher | A01N 31/08 |

FOREIGN PATENT DOCUMENTS

| | | | |
|---|---|---|---|
| CN | 103702766 | A | 4/2014 |
| KR | 1020190076169 | A | 7/2019 |

* cited by examiner

VALVE FOR AEROSOL CONTAINER

CROSS REFERENCE TO RELATED APPLICATIONS

This application is the United States national phase of International Patent Application No. PCT/IN2022/050472 filed May 17, 2022, and claims priority to Indian Patent Application No. 202121023421 filed May 26, 2021, the disclosures of which are hereby incorporated by reference in their entireties.

BACKGROUND OF THE INVENTION

Field of Invention

The present invention relates to a valve for aerosol container. The said valve allows the material/product/liquid in the aerosol container to be sprayed in any angle and position/direction of the aerosol container.

Description of Related Art

Valves for spraying the contents of an aerosol container are known. Usually, the aerosol containers are in vertical or inverted positions especially while spraying the material/product filled in the aerosol container. However, if the aerosol container is tilted or is in a horizontal position or is placed at an angle other than 180 degrees, then sometimes it may not be possible to spray the material/product filled in the aerosol container. The appealing feature about the present invention is that despite the aerosol container being tilted at any angle and position/direction, the material/product filled in the aerosol container can be sprayed continuously as actuated by the user.

BE1003982 discloses an aerosol can with means for forming an aerosol integrated in the valve. The aerosol formulation also occurs when the aerosol can is used upside down. The valve also has passages placed radically to each other thereby allowing the aerosol to flow when the aerosol can is either vertical or inverted, however, such passages merely help the liquid to flow freely from the reservoir to the spray opening, when the push button is activated. Moreover, such a valve is suitable only for specific material/product and the same cannot function in all angles.

U.S. Pat. No. 4,141,472 discloses the use of a membrane for filtration of the material/product stored in the canister. The size of the cap or tap and liquid tap orifices are selected in accordance with the characteristic of the porous membrane and aerosol composition, to provide a volume ratio of gas:liquid passing through the membrane of at least about 8:1, regardless of the orientation of the container. When the container is tipped the liquid can pass through the membrane and does not have time to reach the delivery part of the system while the valve is open, which prevents the liquefied propellant from escaping the container. Such a valve is suitable only for specific material/product and the same cannot function in all angles. At the same time, the device does not contain any mechanism to ensure that the liquefied propellant is flooded in any chamber in order to ensure output at all angles/direction. Thus, the device has limitations on its use.

U.S. Pat. No. 4,475,667A discloses liquid level spray control means comprising a hollow dip tube operatively connected to the valve body and surrounding dip tube. The said hollow dip tube defining an opening means therein spaced below the said valve body base, said opening means defining an open flow path from the container interior, between said dip tube and said hollow tube, and to said valve body, said hollow tube extending downwardly from said valve body base, and said opening means being positioned below said base at least about 20% of the distance between the said base and said dip tube lower end and no more than a distance of about 80% of the distance between said base and said dip tube lower end, said opening means being in flow communication with said valve body interior both when said aerosol container and said valve assembly are in an inverted position and in an upright position. Such a valve is suitable only for specific material/product and the same cannot function in all angles, the construction of the valve relies upon metal balls for opening and closing the communication between the valve body and the dip tube. Thus, the device has limitations on its use.

KR20190076169 discloses a gravity valve for aerosol spray which is installed upon a container filled with liquid and gas and is automatically opened and closed by a ball actuating part, wherein the first actuating ball and second actuating ball move together with the gravity valve for aerosol spraying. The gravitational valve as disclosed in this document is configured such that the opening hole is blocked by the first operating ball inside the ball operation pipe, the second actuating ball is pressed to the upper portion of the second inlet and the fluid is prevented from flowing into the second inlet. The filling liquid introduced into the first inlet moves to the fluid passage through a gap and is discharged to the nozzle through the discharge hole formed in the upper portion. Such a valve is suitable only for specific material/product and the same cannot function in all angles, the construction of the valve relies upon metal balls for opening and closing the communication between the valve body and the first and second inlets. Thus, the device has limitations on its use.

A valve for aerosol container for spraying the material/product filled in an aerosol container while the container is tilted at any angle (360 degrees) and position/direction and which is cost effective and can be manufactured without the use of metal balls or any other balls is yet to be developed for use in day to day life.

It is known in the prior art that a variety of material/product are filled in the aerosol container along with a variety of propellants.

OBJECT OF THE INVENTION

The object of the present invention is to overcome the disadvantages/shortcomings of the devices known in the prior art by providing a valve for aerosol container such that even if the container is tilted at any angle or position/direction the material/product filled in the aerosol container can be sprayed continuously or intermittently as actuated by the user.

Another object of the present invention is to provide a valve for aerosol container which is suitable for all kinds of free-flowing liquids/emulsions.

Yet another object of the present invention is to provide a valve for aerosol container such that various spray patterns can be achieved by different actuators at any angle (360 degrees) and position/direction, for omnidirectional operation.

Yet another object of the present invention is to provide a valve for aerosol container which makes it economical by eliminating the use of metal balls or any other ball. The construction as described in the present invention also uses less plastic which makes it more economical and also reduces the carbon footprint of aerosol containers.

SUMMARY OF THE INVENTION

The present invention relates to a valve for aerosol container comprising a housing, a stem fastened to a mounting cup by a stem gasket, a stem venturi connecting stem to the housing cavity, a spring, a push-button (actuator) at the top of the stem, the said push-button (actuator) having an orifice and a diptube at the bottom of the housing characterized in that at least three housing venturi connect different points of the housing to the inner space of the aerosol container so as to keep the housing cavity flooded with material/product at any angle, position and direction of the aerosol container.

The present invention also relates to a valve for aerosol container as described above, wherein at least four (4) housing venturi connect different points of the housing to the inner space of aerosol container.

The present invention also relates to a valve for aerosol container as described above, wherein at least three (3) stem venturi connect the stem to the housing cavity.

The present invention also relates to a valve for aerosol container as described above, wherein at least four (4) stem venturi connect the stem to the housing cavity.

The present invention also relates to a valve for aerosol container as described above, wherein the diameter of the stem venturi is between 0.1 mm and 1.2 mm The present invention also relates to a valve for aerosol container as described above, wherein the diameter of the housing venturi is between 0.2 mm and 2 mm.

BRIEF DESCRIPTION OF THE DRAWINGS

The following drawings are illustrative of particular examples for enabling the working of the present invention. They are descriptive of the invention and are not intended to limit the scope of the invention. The drawings are not to scale (unless so stated) and are intended for use in conjunction with the explanations in the following detailed description.

In the accompanying drawings.

Persons skilled in the art will appreciate that elements in the figures are illustrated for simplicity and clarity and may have not been drawn to scale. For example, the dimensions of some of the elements in the figures may be exaggerated relative to other elements to help to improve understanding of various exemplary embodiments of the present disclosure. Throughout the drawings, it should be noted that like reference numbers are used to depict the same or similar elements, features, and structures. However, the drawings and/or illustrations in no way limit the scope of the invention. It is understood that modifications and/or alterations of the drawings/illustrations of this invention other than those specifically set forth herein may be achieved by those skilled in the art and that such modifications and alterations are to be considered as falling within the overall scope of this invention.

DESCRIPTION OF THE INVENTION

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

It is also made clear that the description only illustrates the invention and in no way limits the same.

The terms and words used in the following description and claims are not limited to the bibliographical meanings but are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

Figure 1:
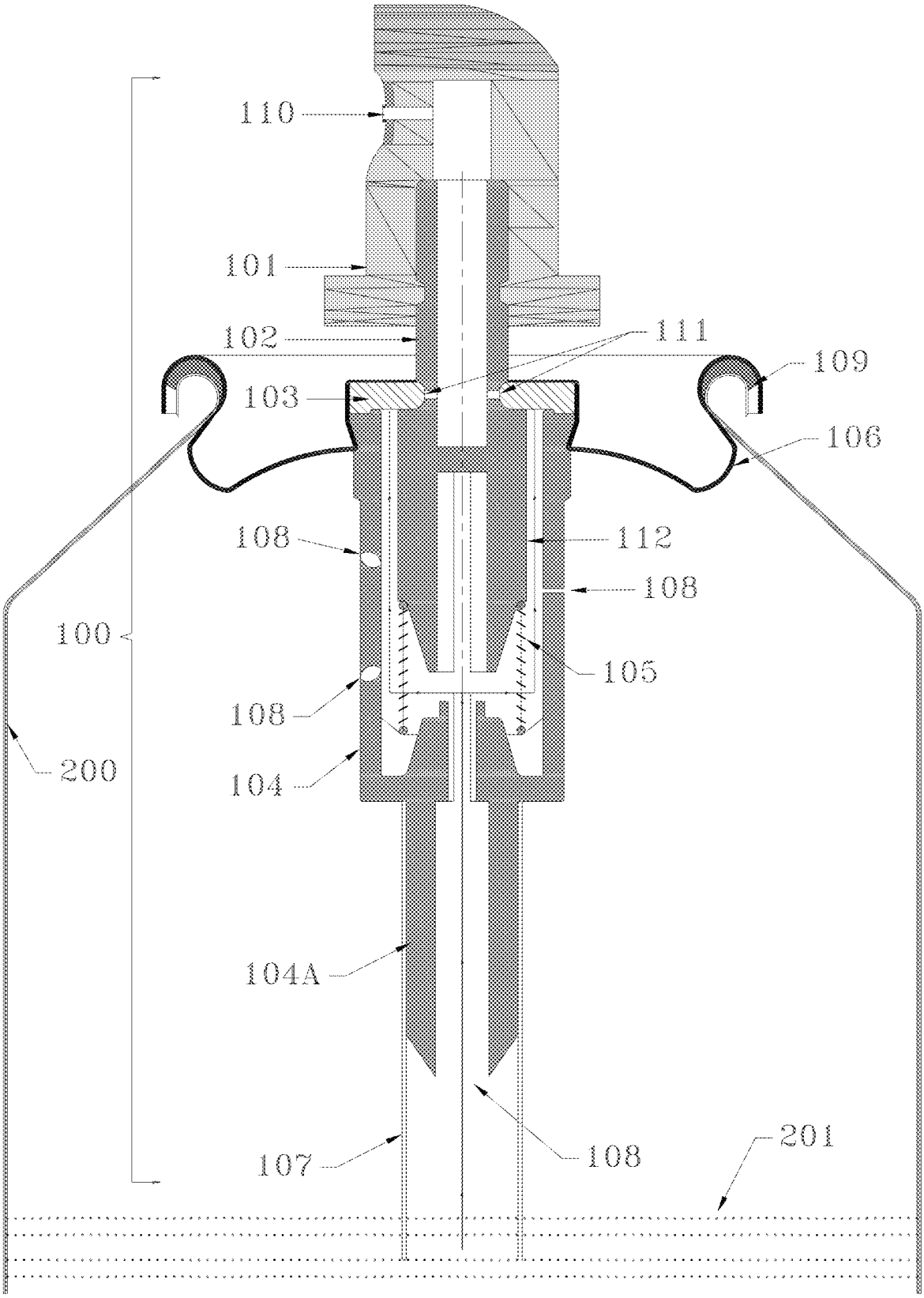
FIG. 1 shows sectional view of the valve 100 according to the present invention, when the valve 100 is not actuated. The valve 100 comprises of the push-button (actuator) 101, orifice 110, stem 102, stem gasket 103, stem venturi 111, housing 104, housing venturi 108, housing cavity 112, tail piece of housing 104A, spring 105, mounting cup 106, cup gasket 109, diptube 107. The aerosol container is shown at 200 and material/product is at 201.

FIG. 1 shows a preferred embodiment of the present invention 100 which is a valve for aerosol container 200 comprising a push-button (actuator) 101 which is mounted upon a stem 102, wherein the type of push-button (actuator) 101 may vary depending upon the required spray pattern.

The stem 102 is fastened to the housing 104 along with the stem gasket 103 and the spring 105 by crimping with mounting cup 106, which is in turn crimped along with the cup gasket 109 onto the aerosol container 200. The spring 105 provides the elasticity required by the stem 102 to supply material/product 201 contained in the aerosol container 200 to the push button (actuator) 101 which when compressed by the user, allows continuous or intermittent spraying by the stem 102 being compressed.

In a preferred embodiment of the present invention the mounting cup 106 is crimped and fastened to the aerosol container 200, the stem gasket 103 is fitted inside the mounting cup 106 and acts as a seal which stops the material/product 201 from flowing out of the aerosol container 200 when the stem 102 is not actuated by the user.

In a preferred embodiment of the present invention the dip tube 107 is attached to the tail piece 104A of the housing 104, wherein the length of the diptube 107 depends upon the size of the aerosol container 200. However, the diptube 107 should be at least slightly above the bottom of the aerosol container 200.

In a preferred embodiment of the present invention the housing 104 comprises of housing venturi 108, stem 102 comprises of stem venturi 111 and the diptube 107 is attached to the tail piece 104A of the housing 104. The diptube 107 and housing venturi 108 on the housing 104 allow the material/product 201 to flow from the aerosol container 200 into the housing cavity 112 and onwards to the stem 102 via the stem venturi 111 and lastly to the push-button (actuator) 101, so that the material/product 201 can be sprayed continuously or intermittently from the orifice 110 as actuated by the user by pressing the push-button (actuator) 101.

Figure 2:
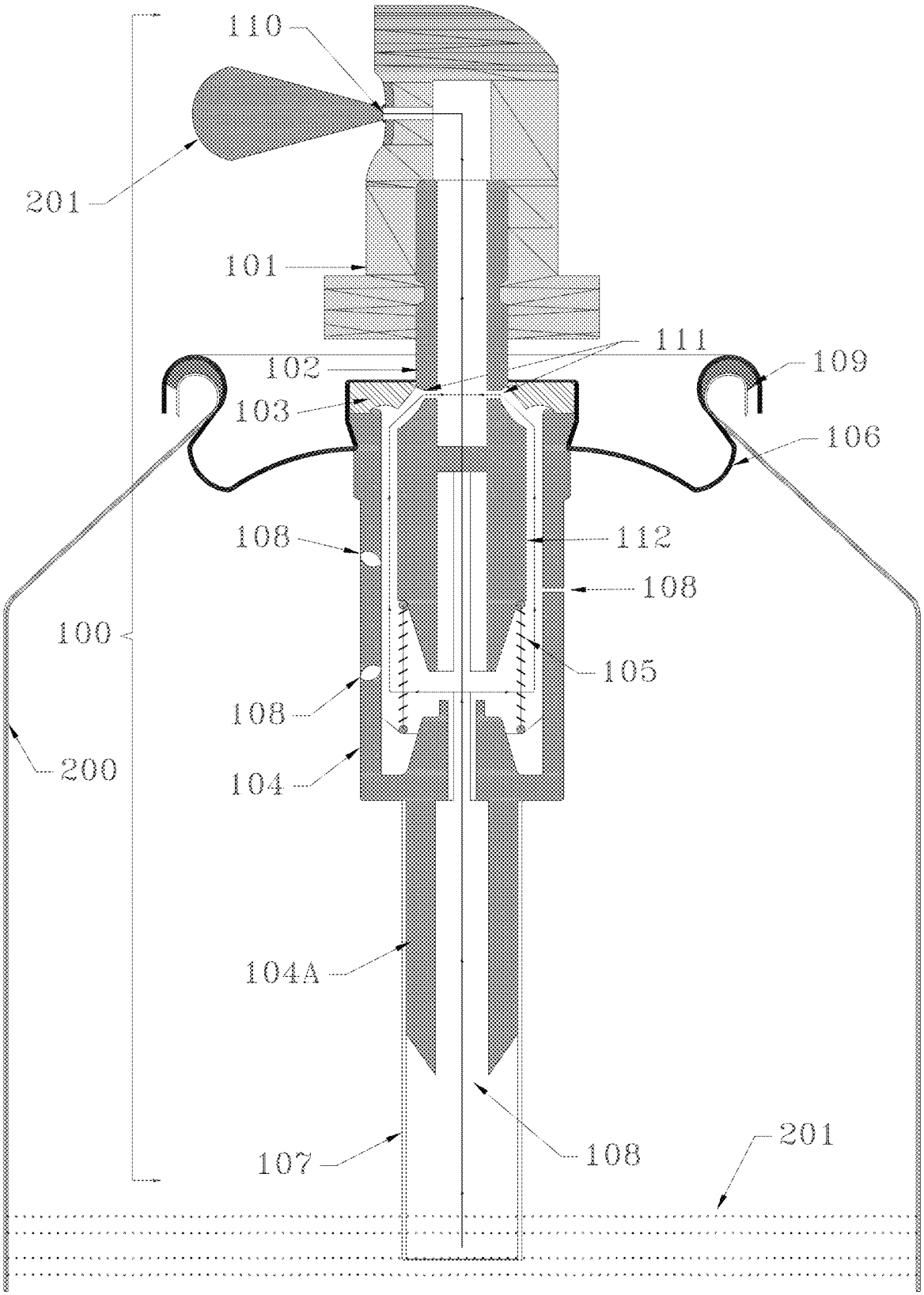
FIG. 2 shows sectional view of the valve 100 according to the present invention, when the valve 100 is in its actuated position. In the said position, the stem 102 and spring 105 are in their compressed position and the stem gasket 103 is flexibly bent to open the stem venturi 111.

In a preferred embodiment of the present invention the housing venturi 108 on the housing 104 together with the diptube 107 which is attached to the tail piece 104A of the housing 104, keep the housing 104 always flooded with material/product 201 when the aerosol container 200 is tilted at any angle (360 degrees) and position/direction for omnidirectional operation. When the push-button (actuator) 101 is pressed by the user, the stem 102 is pressed upon the spring 105 and the stem gasket 103 is flexibly bent to open stem venturi 111 present on the stem 102, which allows the material/product 201 to flow from the housing cavity 112 to the push-button (actuator) 101 through the stem venturi 111 on the stem 102 as shown in FIG. 2.

In a preferred embodiment when the push-button (actuator) 101 is released by the user the spring 105, stem gasket 103 and stem 102 return to the original unactuated position as shown in FIG. 1, the stem venturi 111 present on the stem 102 is sealed by the stem gasket 103 and the material/product 201 filled in the aerosol container 200 stops flowing from the housing cavity 112 into the push-button (actuator) 101.

In a preferred embodiment according to the present invention, there are at least three housing venturi 108 on the housing 104.

In a more preferred embodiment according to the present invention, there are at least 4 or 5 or 6 housing venturi 108 on the housing 104.

In a still preferred embodiment according to the present invention, there are at least three stem venturi 111 on the stem 102. In a more preferred embodiment according to the present invention, there are at least four stem venturi 111 on the stem 102.

In a preferred embodiment of the present invention, when a free-flowing liquid/emulsion is filled in the aerosol container the diameter of the stem venturi is in the range of 0.2 mm to 1.2 mm and the diameter of the housing venturi is in the range of 0.2 mm to 2 mm.

In a preferred embodiment of the present invention the spray pattern of the push-button (actuator) can be selected from one of the following spray patterns namely: Hollow cone narrow dispersal, Hollow cone wide dispersal, Full cone, Spiral full cone, Solid stream, Mist/Fog, Flat fan, etc.

Advantages

1. Venturi and passages in various location of the housing and stem allows the present invention to be very efficient for many applications.
2. Venturi located at different positions help the housing cavity to be flooded with the material/product at any angle, position or direction of the aerosol container.
3. The flow path of the present invention allows proper discharge of material/product filled in the aerosol container when the aerosol container is in any angle and position/direction as required, for omnidirectional operation of the aerosol container.
4. Depending upon the product and the propellant, the position/dimension/profile/number of the venturi can be made to suit the product, propellant for ease of application.
5. Attachments such as extended nozzle/tube for extension, omnidirectional spray pattern and other available attachments can be used in the present invention for the ease of operation.
6. The present invention eliminates components like metal ball(s) which are disclosed in the prior art. There is a reduction in the plastic used for constructing the valve as disclosed in the present invention since the cavity for metal ball(s) is eliminated which makes it more economical.
7. The housing of the present invention can be manufactured in a single process which saves cost and reduces carbon footprint.

Many features and advantages of the invention are apparent from the detailed specification, and thus, it is intended by the appendant claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

I claim:

1. A valve for an aerosol container, the valve comprising;
a housing defining a housing cavity;
a stem defining a passageway and configured to be fastened to a mounting cup by a stem gasket, the housing cavity receiving a portion of the stem;
a stem venturi connecting the passageway of the stem to the housing cavity;
a spring received by the housing;
a push-button at the top of the stem, the push-button having an orifice; and
a diptube at the bottom of the housing,
wherein at least three housing venturi spaced along the housing connect different points of the housing cavity to the inner space of the aerosol container so as to keep the housing cavity flooded with material or product at any angle, position, and direction of the aerosol container, wherein one or more of the at least three housing venturi extend through an outer surface of the housing into the housing cavity.

2. The valve for an aerosol container as claimed in claim 1, wherein at least four housing venturi connect different points of the housing cavity to the inner space of aerosol container.

3. The valve for an aerosol container as claimed in claim 1, wherein at least three stem venturi connect the passageway of the stem to the housing cavity.

4. The valve for an aerosol container as claimed in claim 2, wherein at least four stem venturi connect the passageway of the stem to the housing cavity.

5. The valve for an aerosol container as claimed in claim 1, wherein the diameter of the stem venturi is between 0.1 mm and 1.2 mm.

6. The valve for an aerosol container as claimed in claim 1, wherein the diameter of each of the housing venturi is between 0.2 mm and 2 mm.

7. The valve for an aerosol container as claimed in claim 1, wherein the housing has a first end and second end positioned opposite the first end, the housing comprising a tail piece at the second end of the housing.

8. The valve for an aerosol container as claimed in claim 7, wherein the diptube receives the tail piece of the housing.

9. The valve for an aerosol container as claimed in claim 7, wherein the at least three housing venturi comprises a first housing venturi defined by the tail piece of the housing, a second housing venturi positioned intermediate the first and second ends of the housing, and a third housing venturi position intermediate the first and second ends of the housing, the third venturi spaced from the second venturi along a longitudinal axis defined by the housing.

10. The valve for an aerosol container as claimed in claim 9, wherein the third housing venturi extends through the housing in a direction perpendicular to the longitudinal axis of the housing.

* * * * *